US011064571B2

(12) United States Patent
Goo

(10) Patent No.: US 11,064,571 B2
(45) Date of Patent: Jul. 13, 2021

(54) SHEET HEATING ELEMENT AND ELECTRICALLY CONDUCTIVE THIN FILM

(71) Applicant: Gak Hoi Goo, Chungcheongbuk-do (KR)

(72) Inventor: Gak Hoi Goo, Chungcheongbuk-do (KR)

( * ) Notice: Subject to any disclaimer, the term of this patent is extended or adjusted under 35 U.S.C. 154(b) by 417 days.

(21) Appl. No.: 15/741,404

(22) PCT Filed: Jul. 4, 2016

(86) PCT No.: PCT/KR2016/007197
§ 371 (c)(1),
(2) Date: Jan. 2, 2018

(87) PCT Pub. No.: WO2017/003269
PCT Pub. Date: Jan. 5, 2017

(65) Prior Publication Data

US 2018/0376536 A1 Dec. 27, 2018

(30) Foreign Application Priority Data

Jul. 2, 2015 (KR) ..... 10-2015-0094466

(51) Int. Cl.

| | |
|---|---|
| ***H05B 3/12*** | (2006.01) |
| ***H05B 3/14*** | (2006.01) |
| ***H05B 3/26*** | (2006.01) |
| ***H05B 3/20*** | (2006.01) |
| ***H05B 3/78*** | (2006.01) |

(52) U.S. Cl.
CPC ..... *H05B 3/12* (2013.01); *H05B 3/141* (2013.01); *H05B 3/20* (2013.01); *H05B 3/26* (2013.01); *H05B 3/78* (2013.01); *H05B 2203/013* (2013.01); *H05B 2203/017* (2013.01)

(58) Field of Classification Search
CPC .... H05B 3/141; H05B 3/26; H05B 2203/013; H05B 2203/017; H05B 3/12; H05B 3/20; H05B 3/78
USPC ..... 219/466.1
See application file for complete search history.

(56) References Cited

U.S. PATENT DOCUMENTS

| | | | | |
|---|---|---|---|---|
| 3,388,053 A * | 6/1968 | Sinciair | H01B 1/00 204/192.21 |
| 4,889,974 A * | 12/1989 | Adding | H01C 7/021 219/543 |
| 2006/0016474 A1* | 1/2006 | Shiratsuchi | H01G 9/2031 136/263 |
| 2014/0264231 A1* | 9/2014 | Wang | G11C 13/0002 257/4 |

(Continued)

FOREIGN PATENT DOCUMENTS

| | | |
|---|---|---|
| JP | 2007-109640 | 4/2007 |
| KR | 10-2009-0109807 | 10/2009 |

(Continued)

OTHER PUBLICATIONS

International Search Report dated Oct. 27, 2016 for PCT/KR2016/007197.

*Primary Examiner* — Janie M Loeppke

(57) ABSTRACT

The present invention relates to a film type heater and an electroconductive thin-film. The film type heater includes a substrate; and a heat emitting layer that is formed on the substrate and contains a tin oxide doped with one or more metalloids and one or more post-transition metals.

13 Claims, 2 Drawing Sheets

(56) References Cited

U.S. PATENT DOCUMENTS

2015/0351160 A1* 12/2015 Phan ..... H05B 3/84
219/203

FOREIGN PATENT DOCUMENTS

| | | |
|---|---|---|
| KR | 10-1294596 | 8/2013 |
| KR | 10-2014-0029476 | 3/2014 |
| KR | 10-2015-0019467 | 2/2015 |

* cited by examiner

SHEET HEATING ELEMENT AND ELECTRICALLY CONDUCTIVE THIN FILM

This application claims the priority of Korean Patent Application No. 10-2015-0094466, filed on Jul. 2, 2015 in the KIPO (Korean Intellectual Property Office), the disclosure of which is incorporated herein entirely by reference. Further, this application is the National Stage application of International Application No. PCT/KR2016/007197, filed Jul. 4, 2016, which designates the United States and was published in Korean. Each of these applications is hereby incorporated by reference in their entirety into the present application.

TECHNICAL FIELD

The present invention relates to a thermoelectric device, and more particularly, to a film type heater and an electroconductive thin-film.

BACKGROUND ART

An electric heater, which is resistance-heated as electricity flows, is widely used in various fields due to an ease of controlling temperature of the electric heater, no air contamination, and no noise. A metal resistance wire, such as a nickel-chromium wire, an iron-chromium wire, and a copper-nickel wire, is commonly used as a heat source of such an electric heater.

In an electric heater using the metal resistance wire, since electricity flows through the metal resistance wire, when any portion of the metal resistance wire is opened, the electric heater does not function. If there is a short circuit of the metal resistance wire, there is a risk of fire due to overheating of the metal resistance wire. Furthermore, since the metal resistance wire partially emits heat from a portion with high resistance, distribution of temperatures throughout an electric heater is not uniform. Furthermore, due to relatively high visible ray emissivity and relatively low infrared ray emissivity, heating efficiency of a metal resistance wire is generally low. Furthermore, due to harmfulness to human body based on generation of electromagnetic waves based on a flow of a current, there is a limit for applying an electric heater using the metal resistance wire to fields including medical applications.

As a new electric heater for replacing the metal resistance wire, film type heaters, such as a fibrous heater that is fabricated by dispersing carbon fibers in a base material like a pulp member and a conductive polymer heat-emitting sheet having dispersed therein graphite plate-powders or carbon fibers, are being developed. However, a conventional film type heater is expensive. Furthermore, when conductive particles are utilized, it is difficult to obtain uniform heat emitting efficiency throughout the base material. Therefore, there is a limit to fabricate a large-scale film type heater. Furthermore, it is difficult to embody low-power consumption in the conventional film type heater due to the low infrared ray emissivity thereof as described above, and the maximum temperature of the conventional film type heater should be limited to be relatively low due to poor thermal durability.

DISCLOSURE OF THE INVENTION

Technical Problem

The present invention provides a film type heater and an electroconductive thin-film that exhibits low power consumption, uniform heat emission, excellent heat emitting efficiency, and excellent thermal durability for high temperature heating.

Technical Solution

According to an aspect of the present invention, there is provided a film type heater including a substrate; and a heat emitting layer that is formed on the substrate and contains a tin oxide doped with one or more metalloids and one or more post-transition metals.

According to an embodiment, doping concentration of the metalloid may be relatively high as compared to doping concentration of the post-transition metal. The doping concentration of the post-transition metal may be from about 1/7 to about 1/5 of the doping concentration of the metalloid. The doping concentration of the post-transition metal in the tin oxide may be from about 0.10 at. % to about 0.15 at. %. The doping concentration of the metalloid in the tin oxide may be from about 0.65 at. % to about 0.75 at. %. The doping concentrations of the post-transition metal and the metalloid may be determined on the basis that sheet resistance decreases as the doping concentration of the post-transition metal increases and sheet resistance increases as the doping concentration of the metalloid increases, such that the film type heater emits heat within a certain temperature range.

According to an embodiment, the metalloid may include at least one selected from a group consisting of boron (B), silicon (Si), germanium (Ge), arsenic (As), antimony (Sb), and tellurium (Te). The post-transition metal may include at least one selected from a group consisting of aluminum (Al), gallium (Ga), indium (In), tin (Sn), thallium (Tl), lead (Pb), bismuth (Bi), and polonium (Po).

The metalloid may include antimony (Sb), whereas the post-transition metal may include bismuth (Bi). According to an embodiment, the metalloid and the post-transition metal may exist as oxides in the tin oxide.

According to an embodiment, a plane {110} of an X-ray diffraction angle 2θ (theta) may have a peak at an angle from about 20° to about 30°, and a plane {211} of the X-ray diffraction angle 2θ may have a peak at an angle from about 45° to about 55°. According to an embodiment, the thickness of the heat emitting layer is from about 100 nm to about 500 nm. According to an embodiment, temperature of heat emitted by the film type heater may be from about 500° C. to about 800° C.

According to an embodiment, the film type heater may further include a metal electrode formed on the heat emitting layer. According to an embodiment, the film type heater may further include a protecting layer stacked on the heat emitting layer. Furthermore, the heat emitting layer and the protecting layer may be alternately and repeatedly stacked.

According to an embodiment, the film type heater may be applied to medical devices, health aid devices, accessories with heating function, household electronics, a building, a floor of a building, a finishing material like a tile, bricks, an interior material or an exterior material for a building or a motor vehicle, an agricultural equipment, an industrial oven, a printed circuit board (PCB), a transparent electrode, and a solar battery, a print ink, or a marine paint.

According to another aspect of the present invention, there is provided an electroconductive thin-film that is formed on a substrate and includes a tin oxide doped with one or more metalloids and one or more post-transition metals.

Advantageous Effects

According to an embodiment of the present invention, by including a thin-film type heat emitting layer including a tin oxide doped with a metalloid (preferably, antimony (Sb)) and a post-transition metal (preferably, bismuth (Bi)), heat emission uniformity may be obtained, and thus a large-scale film type heater that may be operated at low power may be provided.

Furthermore, according to an embodiment of the present invention, excellent heat emitting efficiency and thermal durability may be obtained due to a low sheet resistance, and thus a film type heater having a long-life expectancy may be provided.

Furthermore, according to an embodiment of the present invention, an electroconductive thin-film having the above-stated advantages may be provided.

MODE FOR CARRYING OUT THE INVENTION

Figure 1A:
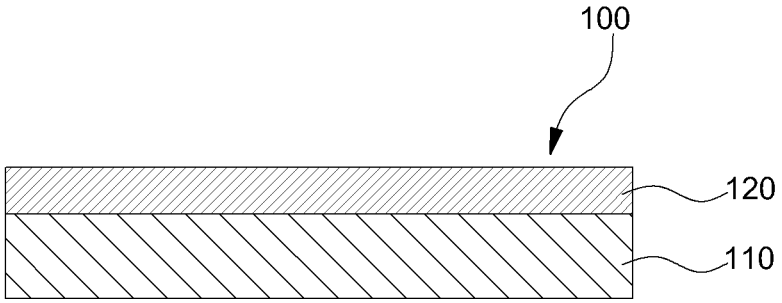
FIGS. 1A through 1C are schematic sectional views of a film type heater according to an embodiment of the present invention.

The present invention will now be described more fully with reference to the accompanying drawings, in which exemplary embodiments of the present invention are shown.

The present invention may, however, be embodied in many different forms and should not be construed as being limited to the embodiments set forth herein; rather these embodiments are provided so that this disclosure will be thorough and complete, and will fully convey the concept of the present invention to one of ordinary skill in the art. Meanwhile, the terminology used herein is for the purpose of describing particular embodiments only and is not intended to be limiting of exemplary embodiments.

Also, thickness or sizes of layers in the drawings are exaggerated for convenience of description and clarity, and the same reference numerals denote the same elements in the drawings. As used herein, the term "and/or" includes any and all combinations of one or more of the associated listed items.

The terminology used herein is for the purpose of describing particular embodiments only and is not intended to be limiting of exemplary embodiments. As used herein, the singular forms "a," "an" and "the" are intended to include the plural forms as well, unless the context clearly indicates otherwise. It will be further understood that the terms "comprises" and/or "comprising" used herein specify the presence of stated features, integers, steps, operations, members, components, and/or groups thereof, but do not preclude the presence or addition of one or more other features, integers, steps, operations, members, components, and/or groups thereof.

Furthermore, throughout the specification, it will be understood that when a portion is referred to as being "connected to" another portion, it can be "directly connected to" the other portion or "indirectly connected to" the other portion via another element.

Figure 1B:
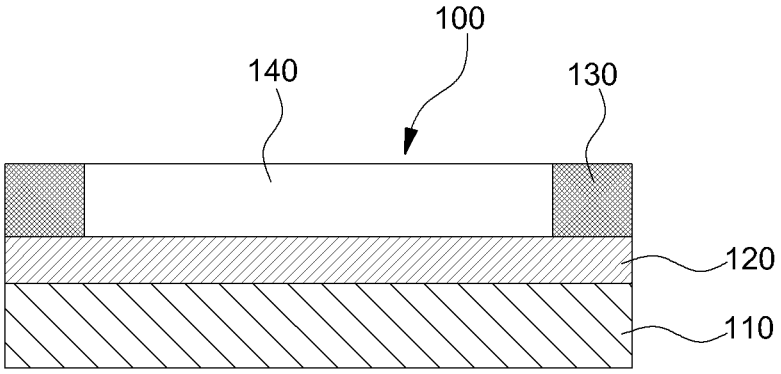
Figure 1C:
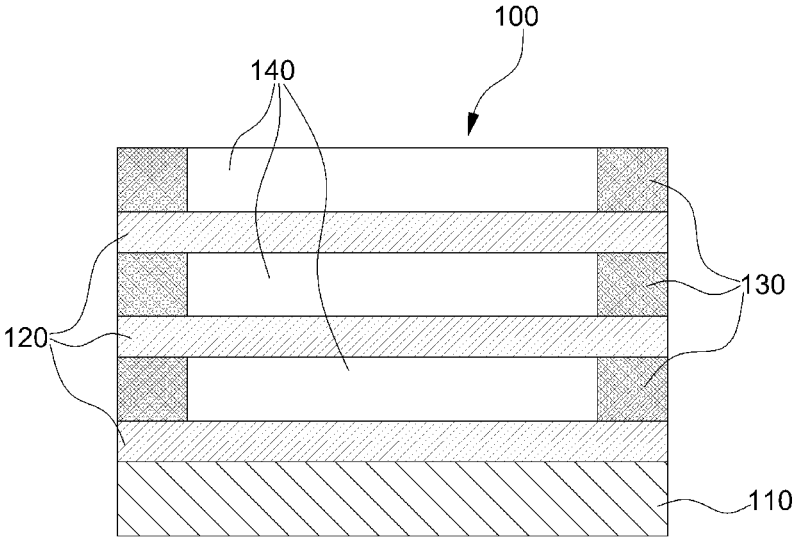

FIGS. 1A through 1C are schematic sectional views of a film type heater 100 according to an embodiment of the present invention.

Referring to FIG. 1A, the film type heater 100 may include a substrate 110 and a heat emitting layer 120. The substrate 110 may include glass, quartz, ceramic, soda lime, plastic, polyethylene terephthalate resin, polyethylene resin, or polycarbonate resin. Preferably, the substrate 110 may include glass.

The heat emitting layer 120 may be formed on the substrate 110. The heat emitting layer 120 may include a tin oxide doped with one or more type of metalloid and one or more type of post-transition metal. The metalloid and the post-transition metal may exist as oxides in the tin oxide. The metalloid has properties between those of metals and non-metals. For example, the metalloid includes boron (B), silicon (Si), germanium (Ge), arsenic (As), antimony (Sb), or tellurium (Te). The metalloid may include antimony (Sb).

Doping concentration of the metalloid in the tin oxide may be from about 0.65 at. % to about 0.75 at. % (atomic number ratio). If the doping concentration of the metalloid in the tin oxide is less than 0.65 at. %, it is difficult for the metalloid to function as a dopant in the tin oxide. If the doping concentration of the metalloid in the tin oxide exceeds 0.75 at. %, sheet resistance increases, and thus temperature of heat emitted by the film type heater 100 may decrease.

The post-transition metal exhibits a melting point and a boiling point lower than those of transition metals, thus being more reactive in the tin oxide than transition metals. For example, the post-transition metal includes aluminum (Al), gallium (Ga), indium (In), tin (Sn), thallium (Tl), lead (Pb), bismuth (Bi), or polonium (Po). The post-transition metal may include bismuth (Bi).

Doping concentration of the post-transition metal in the tin oxide is from about 0.10 at. % to about 0.15 at. %. If the doping concentration of the post-transition metal is less than about 0.1 at. %, it is difficult for the post-transition metal to function as a dopant in the tin oxide. If the doping concentration of the post-transition metal exceeds about 0.15 at. %, structural stabilization of a film type heater may be degraded due to the highly reactive post-transition metal. However, within the above-stated range of doping concentration, the post-transition metal is strongly bonded to oxygen in the tin oxide, thereby stabilizing structure of a film type heater. As a result, thermal durability of the film type heater may be improved.

In an embodiment, sheet resistance is more influenced by the doping concentration of the post-transition metal than by the doping concentration of the metalloid, the doping concentration of the post-transition metal may be relatively small as compared to the doping concentration of the metalloid. In an embodiment, the doping concentration of the post-transition metal may be from about 1/7 to about 1/5 of the doping concentration of the metalloid. Within the above-stated range of doping concentrations of the post-transition metal, the matrix of a film type heater may be stabilized by the post-transition metal, and therefore thermal durability and infrared ray emitting efficiency of the film type heater may be improved, and simultaneously, electroconductivity of the film type heater may be improved by the metalloid to enhance heat emitting efficiency of the film type heater. If the doping concentration of the post-transition metal is less than 1/7 of the doping concentration of the metalloid, temperature of heat emitted with same power consumption is low, and thus thermal durability and electricity-heat conversion efficiency are not improved by doping the post-transition metal. Meanwhile, if the doping concentration of the post-transition metal exceeds 1/5 of the doping concentration of the metalloid, light transmittance may be reduced to below 70% and temperature of emitted heat rapidly decreases.

In an example, the doping concentrations of the post-transition metal and the metalloid may be determined based on the fact that sheet resistance decreases as the doping concentration of the post-transition metal increases and sheet resistance increases as the doping concentration of the metalloid increases, such that the film type heater may be designed to emit heat within a certain temperature range.

Thickness of the heat emitting layer 120 may be from about 100 nm to about 500 nm. When the heat emitting layer 120 has a thickness smaller than 100 nm, heat emitting effect may be insufficient due to a small heat capacity for a high resistance. When the heat emitting layer 120 has a thickness greater than 500 nm, it may be difficult to uniformly form the heat emitting layer 120 on the substrate 110 or a defect, such as a crack, may occur due to a factor like a difference between thermal expansion coefficients of the substrate 110 and the heat emitting layer 120. Preferably, the heat emitting layer 120 may have a thickness from about 200 nm to about 400 nm, where mechanical strength of a thin-film (the heat emitting layer 120) which are factors determining life expectancy of the thin-film, and temperature of emitted heat are optimized in the range. Temperature of heat emitted by the heat emitting layer 120 may be from about 500° C. to about 800° C.

Sheet resistance of the heat emitting layer 120 may be from about 40 Ohm/sq. to about 500 Ohm/sq. Sheet resistances of thin-films having a same composition ratio may vary according to thicknesses of the thin-films.

Transmittance of the heat emitting layer 120 may be from about 70% to about 100% within a range of visible rays (from about 300 nm to about 700 nm) within the above-stated range of doping concentrations. The heat emitting layer 120 is seen as being transparent by the naked eyes. If transmittance of the heat emitting layer 120 is less than 70%, the heat emitting layer 120 becomes opaque due to impurities. Preferably, the heat emitting layer 120 may have an average transmittance of about 87%.

The heat emitting layer 120 may be formed by using a solution evaporation method. The heat emitting layer 120 may be formed by evaporating a dispersion solution and depositing the same on the substrate 110 in deposition equipment at a temperature from about 300° C. to about 600° C. The dispersion solution may include an alcohol, such as ethanol, methanol, or butanol. The precursor may include tin chloride ($SnCl_4$), antimony trichloride ($SbCl_3$) and bismuth chloride ($BiCl_3$) containing dopant atoms. If necessary, a salt, such as aluminum trichloride ($AlCl_3$), manganese trichloride ($MnCl_3$), or cobalt trichloride ($CoCl_3$) may be further added thereto as an additional dopant. The precursors may be mixed into the solvent at respectively suitable concentrations to satisfy the above-stated composition range. In an embodiment, a catalyst, such as a metal chloride, that helps chemical bonding of the precursors may be further added to the dispersion solution.

In an embodiment, the deposition equipment may include a source unit that heats a dispersion solution, a supporting unit that supports the substrate 110 to deposit an in-process material evaporated from the dispersion solution on the substrate 110, and a depositor that has a heat source for heating the substrate 110.

When the dispersion solution is evaporated, bond between chlorine (Cl) and tin (Sn) of tin chloride ($SnCl_4$) may be broken, and the tin (Sn) may be combined with oxygen (O) in the air, and thus tin oxide ($SnO_x$) may be formed. Binding energy of the tin oxide may be 486.4 eV. The tin oxide may be tin dioxide ($SnO_2$). The tin oxide may be crystalline.

The above-mentioned solution evaporation method is merely an example, and the present invention is not limited thereto. For example, the heat emitting layer 120 may be formed by using a chemical vapor deposition (CVD) method, a plasma enhanced chemical vapor deposition (PECVD) method, a solution coating method, or a sputtering method.

In an embodiment, the above-stated film type heater 100 may be an electroconductive thin-film. In other words, the electroconductive thin-film may include the substrate 110 and the heat emitting layer 120, which may be formed on the substrate 110 and may be doped with one or more metalloids and one or more post-transition metals.

Referring to FIG. 1B, in the film type heater, a metal electrode 130 may be formed on the heat emitting layer 120. Furthermore, a protecting layer 140 may be further formed on the heat emitting layer 120 having formed thereon the metal electrode 130.

The metal electrodes 130 may be formed at two opposite ends of the top surface of heat emitting layer 120. The metal electrode 130 may be a cathode or an anode. The metal electrode 130 directly contacts a portion of the heat emitting layer 120, e.g., an edge portion, and may be electrically connected thereto, where a wire (not shown) may be formed on a portion of the metal electrode 130 and may interconnect the heat emitting layer 120 and an external circuit (e.g., a power supply circuit and/or a driving circuit).

Since it is necessary for the metal electrode 130 to transfer an electric current to the heat emitting layer 120, a material constituting the metal electrode 130 may be selected from materials that may exhibit low resistances and may be easily and firmly attached. For example, the metal electrode 130 may include a metal, such as aluminum (Al), silver (Ag), gold (Au), tungsten (W), and/or copper (Cu). The metal electrode 130 may be fabricated as a thin-film by using a vapor deposition method, such as a sputtering method. However, the present invention is not limited thereto, and the metal electrode 130 may include a transparent conductive oxide thin-film, such as an indium tin oxide (ITO) thin-film, or may be fabricated by using a coating method using slurries of the above-stated metals.

The protecting layer 140 is a layer for protecting the heat emitting layer 120 from outside environment and may include a heat-resistant and moisture-resistant material. The protecting layer 140 may include at least one of a dielectric oxide, such as magnesium oxide (MgO), and a woven or non-woven fabric. The protecting layer 140 may be stacked by using a vapor deposition method, a spray coating method using a dispersion solvent, a spin coating method, a dipping method, a brushing method, or one of various other wet-coating methods, or may be stacked by using an adhesive.

The woven or non-woven fabric may be a woven or non-woven fabric including one or more types of synthetic resin fibers, such as polyester fibers, polyamide fibers, polyurethane fibers, acrylic fibers, polyolefin fibers, and cellulose fibers; a woven or non-woven cotton fabric; or a woven or non-woven fabric including a mixture of the above-stated synthetic resin fibers and cotton fibers. A method of fabricating a woven or non-woven fabric by using materials as described above is not limited. For example, a woven or non-woven fabric may be fabricated in a common paper-milling process or a common weaving process.

Referring to FIG. 1C, the film type heater may have a structure in which the heat emitting layer 120, the metal electrode 130, and the protecting layer 140 are alternately and repeatedly stacked on the substrate 110. The heat emitting layer 120 may have a stacked structure in which a plurality of layers is stacked, such that doping concentration of a dopant included in the heat emitting layer 120 may vary in the depthwise direction. Accordingly, when it is unable to obtain a required physical characteristic or electric characteristic from the single heat emitting layer 120, a heat emitting layer having a stacked structure of a plurality of heat emitting layers may be employed to obtain the required characteristic.

Figure 2:
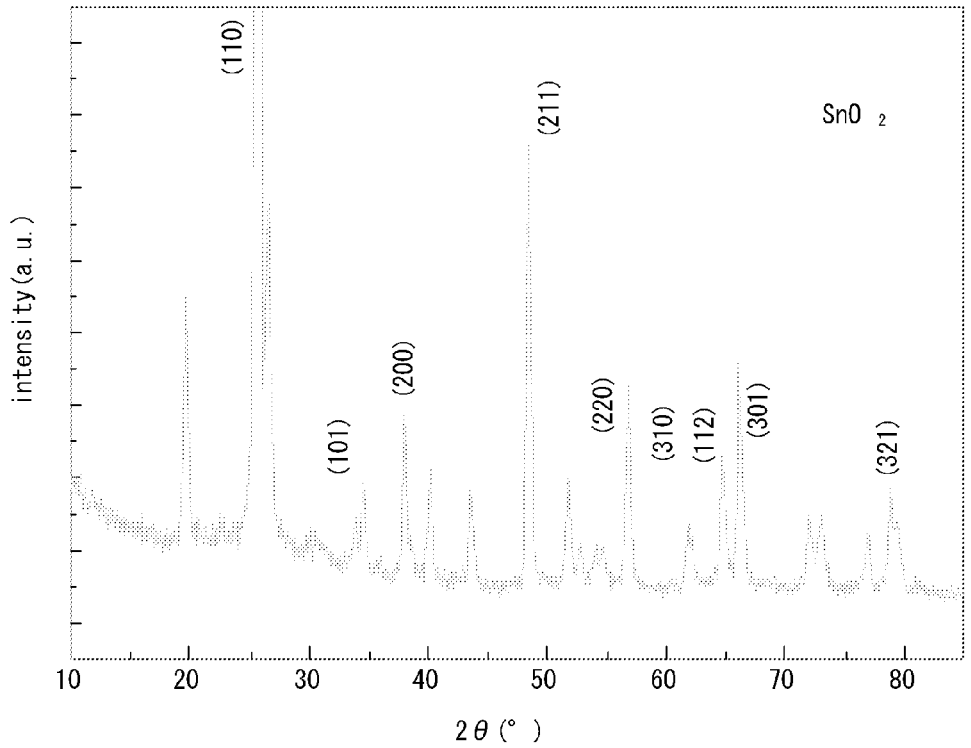
FIG. 2 is a graph showing a result of an X-ray diffraction (XRD) analysis of a film type heater according to an embodiment.

FIG. 2 is a graph showing a result of an X-ray diffraction (XRD) analysis of a film type heater according to an embodiment.

Referring to FIG. 2, in an X-ray diffraction of a film type heater according to an embodiment, a plane {110} of a diffraction angle 2θ (theta) has a peak at an angle from about 20° to about 30°, planes {101} and {200} have peaks at angles from about 30° to about 40°, and a plane {211} has a peak at an angle from about 45° to about 55°. Planes {220}, {310}, {112}, {301}, and {321} have peaks at angles from about 55° to about 80°. Therefore, the film type heater has a rutile crystal structure. The film type heater 100 has a strongly crystalline structure, where the film type heater 100 may have a pillar-like cross-section.

The film type heater may be applied to various fields that require heaters. For example, the film type heater may be applied to medical devices or health aid devices, such as an infrared ray warmer and a massager; household electronics, such as a hair dryer, a curler, an iron, an instantaneous water heater, a hot water tank, a boiler, a temperature maintaining device, an electric stove, an accessory with heating function, a grill, a kitchen range, a toaster, a washer, a rice cooker, a coffee maker, and a thermos flask; a building, a floor of a building, a finishing material like a tile, bricks, an interior material or an exterior material for a building or a motor vehicle; an automated equipment, such as a paint dryer, a hot air blower, and a mirror defroster; an agricultural equipment, such as a crop dryer for drying peppers and fruits, a greenhouse managing equipment, an agricultural hot wind blower, and a plastic house warmer; and an industrial oven for drying a sealant to cure the same or for melting or heating various materials. The film type heater may also be applied to improve efficiency and durability of a printed circuit board (PCB), a transparent electrode, and a solar battery and may be applied to various industrial devices including a print ink or a circuit board. Furthermore, the film type heater may be applied to a marine paint or a marine product.

Hereinafter, embodiments of the present invention will be described below in closer details with reference to experimental embodiments. Numbers in the below experimental embodiments are merely examples, and the present invention is not limited thereto

Experiment Embodiment 1

A dispersion solution for a vapor deposition was prepared according to the above-stated embodiments. For the composition as shown in Table 1, 5 g of the dispersion solution was prepared by mixing methanol, tin chloride ($SnCl_4$) as a precursor of a matrix, antimony trichloride ($SbCl_3$) as a precursor of a metalloid, and bismuth chloride ($BiCl_3$) having suitable weights with one another, where the dispersion solution was heated in a deposition equipment at a temperature from about 300° C. to about 600° C. and was deposited onto a heated substrate.

Experiment Embodiment 2

A dispersion solution for a vapor deposition was prepared according to the above-stated embodiments. For the composition as shown in Table 1, 10 g of the dispersion solution was prepared by mixing methanol, tin chloride ($SnCl_4$) as a precursor of a matrix, antimony trichloride ($SbCl_3$) as a precursor of a metalloid, and bismuth chloride ($BiCl_3$) having suitable weights with one another, where the dispersion solution was heated in a deposition equipment at a temperature from about 300° C. to about 600° C. and was deposited onto a heated substrate.

Comparative Example

A dispersion solution for a vapor deposition was prepared according to the above-stated embodiments. For the same composition as shown in Table 1, 5 g of the dispersion solution was prepared by mixing methanol having a suitable weight with tin chloride ($SnCl_4$) having a suitable weight, where the dispersion solution was heated in a deposition equipment at a temperature from about 300° C. to about 600° C. and was deposited onto a heated substrate.

Compositions of Experimental Embodiments and Composition of Comparative Example Table 1 shows composition ratios of the film type heater according to the experimental embodiments and the comparative example obtained by analysing the same using an X-ray photoelectron spectroscopy (XPS). The unit of the composition ratios is at. %.

TABLE 1

| | Experimental Embodiment 1 | Experimental Embodiment 2 | Comparative Example |
|---|---|---|---|
| Carbon (C) | 0 | 0 | 0 |
| Tin (Sn) | 46.54 | 45.9 | 47.92 |
| Oxygen (O) | 51.37 | 52.91 | 52.18 |
| Antimony (Sb) | 0.67 | 0.74 | 0 |
| Bismuth (Bi) | 0.12 | 0.12 | 0 |

Experiment 1 Regarding Characteristics of Experimental Embodiments and Comparative Example Table 2 shows sheet resistances of the film type heaters of the experimental embodiment 1, the experimental embodiment 2, and the comparative example measured by using a 4-point probe and maximum temperatures of the film type heaters measured when voltages of 220V were applied to contact portions of two opposite end electrodes of each of the film type heaters.

TABLE 2

| | Experimental Embodiment 1 | Experimental Embodiment 2 | Comparative Example |
|---|---|---|---|
| Max. Temperature(° C.) | 650 | 670 | 127 |
| Sheet Resistance (Ohm/sq.) | 165 | 80 | 680 |

Each of the film type heaters according to the experimental embodiments is formed from dispersion solution including antimony trichloride ($SbCl_3$) and bismuth chloride ($BiCl_3$), thus including antimony (Sb) as a metalloid and a tin oxide doped with bismuth (Bi) as a post-transition metal. The film type heater according to the comparative example is formed from a dispersion solution that does not include antimony trichloride ($SbCl_3$) and bismuth chloride ($BiCl_3$). Therefore, the film type heater according to the comparative example includes antimony (Sb) as a metalloid and a tin oxide not doped with bismuth (Bi) as a post-transition metal.

The sheet resistances in the experimental embodiment 1 and the experimental embodiment 2 were relatively low compared to the sheet resistance in the comparative example. According to power consumption $P=V^2/R$ in case of applying a constant voltage of 220V, as the sheet resistances in the experimental embodiment 1 and the experimental embodiment 2 were relatively low, the maximum temperatures in the experimental embodiment 1 and the experimental embodiment 2 were higher than the maximum temperature in the comparative example. The reason thereof may be that the film type heaters of the experimental embodiment 1 and the experimental embodiment 2 doped with antimony (Sb) as a metalloid and a bismuth (Bi) as a post-transition metal exhibit superior heating efficiency that the film type heater of the comparative example. Therefore, according to an embodiment of the present invention, excellent heating efficiency may be obtained due to a low sheet resistance.

Figure 3:
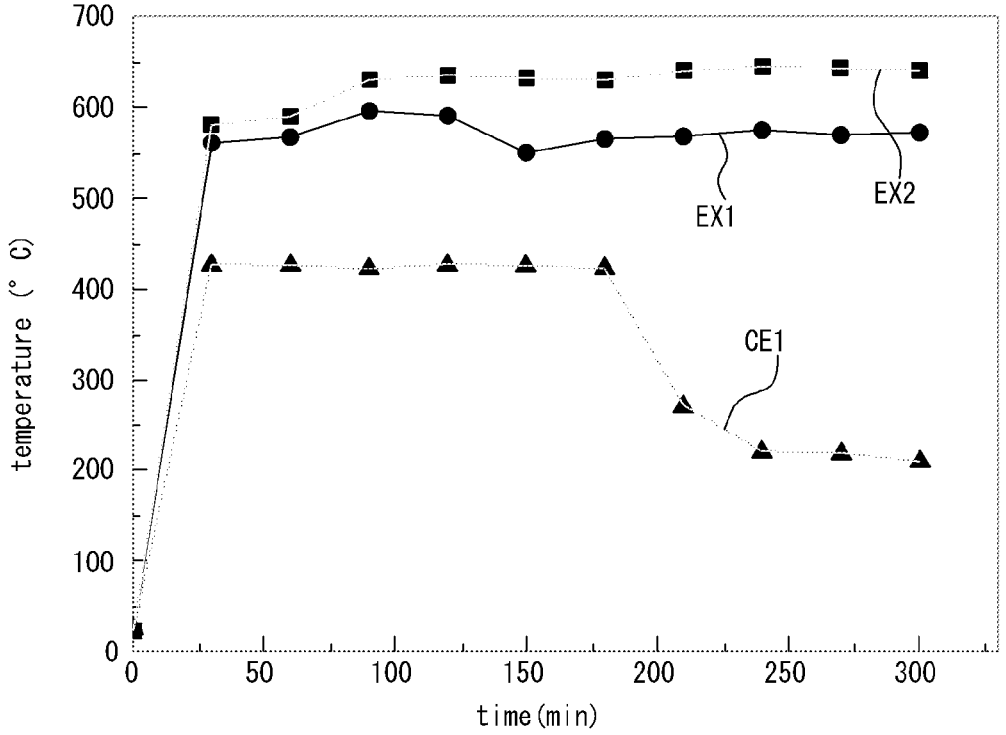
FIG. 3 is a graph showing changes of temperatures of film type heater according to the experimental embodiments of the present invention and the comparative example according to the lapse of time.

Experiment 1 Regarding Characteristics of Experimental Embodiments and Comparative Example FIG. 3 is a graph showing changes of temperatures of film type heater according to the experimental embodiments of the present invention and the comparative example according to the lapse of time.

Referring to FIG. 3, the film type heater including a tin oxide that is not doped with antimony (Sb) as a metalloid and bismuth (Bi) as a post-transition metal according to the comparative example CE1 maintained its temperature around 400° C. for about 180 minutes and the temperature of the sheet resistance was rapidly dropped. However, the film type heaters of the experimental embodiment 1 (EX1) and the experimental embodiment 2 (EX2) including a tin oxide that is not doped with antimony (Sb) as a metalloid and bismuth (Bi) as a post-transition metal maintained their temperatures from about 500° C. to about 700° C. for about 300 minutes. Therefore, the film type heaters according to the present embodiment exhibit relatively good temperature durability.

According to an embodiment of the present invention, by including a thin-film type heat emitting layer including a tin oxide doped with a metalloid (preferably, antimony (Sb)) and a post-transition metal (preferably, bismuth (Bi)), a film type heater may be operated at low power. Furthermore, according to an embodiment of the present invention, a film type heater may exhibit excellent heat emitting efficiency and thermal durability due to a low sheet resistance, and thus life expectancy of the film type heater may be improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A sheet heating element comprising:

a substrate; and a heat emitting layer that is formed on the substrate and contains a tin oxide doped with one or more metalloids and one or more post-transition metals, wherein doping concentration of the metalloid is relatively high as compared to doping concentration of the post-transition metal, wherein the doping concentration of the post-transition metal is from about 1/7 to about 1/5 of the doping concentration of the metalloid, wherein the doping concentration of the post-transition metal in the tin oxide is from about 0.10 at. % to about 0.15 at. %, wherein the doping concentration of the metalloid in the tin oxide is from about 0.65 at. % to about 0.75 at. %, wherein sheet resistance of the heat emitting layer is from 40 Ohm/sq. to 500 Ohm/sq., wherein transmittance of the heat emitting layer is from 70% to 100% within a range of visible rays, wherein the heat emitting layer has a rutile crystal structure.

2. The film type heater of claim 1, wherein the doping concentrations of the post-transition metal and the metalloid is determined on the basis that sheet resistance decreases as the doping concentration of the post-transition metal increases and sheet resistance increases as the doping concentration of the metalloid increases, such that the film type heater emits heat within a certain temperature range.

3. The film type heater of claim 1, wherein the metalloid comprises at least one selected from the group consisting of boron (B), silicon (Si), germanium (Ge), arsenic (As), antimony (Sb), and tellurium (Te).

4. The film type heater of claim 1, wherein the post-transition metal comprises at least one selected from the group consisting of aluminium (Al), gallium (Ga), indium (In), tin (Sn), thallium (Tl), lead (Pb), bismuth (Bi), and polonium (Po).

5. The film type heater of claim 1, further comprising a metal electrode formed on the heat emitting layer.

6. The film type heater of claim 1, further comprising a protecting layer stacked on the heat emitting layer.

7. The film type heater of claim 6, wherein the heat emitting layer and the protecting layer are alternately and repeatedly stacked one or more times.

8. The film type heater of claim 1, wherein temperature of heat emitted by the film type heater is from about 500° C. to about 800° C.

9. The film type heater of claim 1, wherein the metalloid and the post-transition metal exist as oxides in the tin oxide.

10. The film type heater of claim 1, wherein a plane {110} of an X-ray diffraction angle 2θ(theta) has a peak at an angle from about 20° to about 30°, and a plane {211} of the X-ray diffraction angle 2θ has a peak at an angle from about 45° to about 55°.

11. The film type heater of claim 1, wherein the thickness of the heat emitting layer is from about 100 nm to about 500 nm.

12. The film type heater of claim 1, wherein the film type heater is applicable to medical devices, health aid devices, accessories with heating function, household electronics, a building, a floor of a building, a finishing material like a tile, bricks, an interior material or an exterior material for a building or a motor vehicle, an agricultural equipment, an industrial oven, a printed circuit board (PCB), a transparent electrode, and a solar battery, a print ink, or a marine paint.

13. An electrically conductive thin-film that is formed on a substrate and comprises a tin oxide doped with one or more metalloids and one or more post-transition metals, wherein doping concentration of the metalloid is relatively high as compared to doping concentration of the post-transition metal, wherein the doping concentration of the post-transition metal is from about 1/7 to about 1/5 of the doping concentration of the metalloid, wherein the doping concentration of the post-transition metal in the tin oxide is from about 0.10 at. % to about 0.15 at. %, wherein the doping concentration of the metalloid in the tin oxide is from about 0.65 at. % to about 0.75 at. %, wherein sheet resistance of the heat emitting layer is from 40 Ohm/sq. to 500 Ohm/sq., wherein transmittance of the heat emitting layer is from 70% to 100% within a range of visible rays, wherein the heat emitting layer has a rutile crystal structure.

* * * * *